US005662083A

United States Patent [19]

Patyi

[11] Patent Number: 5,662,083

[45] Date of Patent: Sep. 2, 1997

[54] METERING DEVICE FOR AIR ASSISTED FUEL INJECTION

[75] Inventor: Michael P. Patyi, Troy, Mich.

[73] Assignee: Chrysler Corporation, Auburn Hills, Mich.

[21] Appl. No.: 728,024

[22] Filed: Oct. 9, 1996

[51] Int. Cl.[6] ..... F02D 41/16

[52] U.S. Cl. ..... 123/339.27; 123/585; 137/628

[58] Field of Search ..... 123/531, 585, 123/339.27; 137/628, 629

[56] References Cited

U.S. PATENT DOCUMENTS

| | | | |
|---|---|---|---|
| 1,076,446 | 10/1913 | Pape | 137/630.19 |
| 3,335,756 | 8/1967 | McPherson | 137/630.19 |
| 3,740,106 | 6/1973 | Horowitz | 137/630.19 |
| 4,096,784 | 6/1978 | Ongaro | 137/630.19 |
| 4,387,695 | 6/1983 | Hoppel et al. | 123/585 |
| 4,796,594 | 1/1989 | Duret | 123/585 |
| 5,156,133 | 10/1992 | Sugimoto et al. | 123/533 |
| 5,207,204 | 5/1993 | Kawachi et al. | 123/533 |

OTHER PUBLICATIONS

"Develpment of Air-Assisted Injector System", Toyota Motor Corp., Aisan Industry Corp.,Ltd.

*Primary Examiner*—Noah P. Kamen
*Attorney, Agent, or Firm*—Kenneth H. MacLean

[57] ABSTRACT

In an engine air assisted fuel injection system, it is desirable to provide a first range of air flow during engine idle and at low loading conditions. At greater engine speeds and higher loading conditions, a substantially greater second range of air flow is desired. This flow characteristic is achieved by the subject air metering device having dual valve members mounted on an axially positionable shaft. The valves are mounted so that initial movements of the shaft opens only one valve to provide flows within the first range. Further movement of the shaft then opens the second valve to provide flows within the second range.

4 Claims, 2 Drawing Sheets

AIR FLOW RATE

SHAFT MOVEMENT

METERING DEVICE FOR AIR ASSISTED FUEL INJECTION

BACKGROUND OF THE INVENTION

1. Technical Field of the Invention

The technical field of this invention relates to an air assisted fuel injection system for an internal combustion engine and more specifically a sequentially operating dual stage air metering valve including dual valves on a common shaft.

2. Description of Related Art

Air assisted fuel injection systems are known in the engine art particularly concerning internal combustion engines. Also, the utilization of an air flow control device or a metering valve is known to regulated the flow characteristics to the fuel injectors. For example, an air assisted fuel injection system including a metering valve is disclosed in a Society of Automotive Engineers (SAE) Paper No. 92029. In this paper, the authors illustrate and describe an air flow control device which has an air inlet and two air outlets. The inlet is connected to a source of pressurized air sufficient to cause a flow to the control device. One air outlet is connected to an inlet associated with an air assist type fuel injector. A second air outlet is connected the intake manifold of an internal combustion engine. Air supplied through the one outlet flows directly past the fuel outlet of the injector and so envelopes the spray pattern of fuel from the fuel injector. Air supplied through the second outlet flows into the intake manifold and subsequently mixes with the fuel introduced by the fuel injector.

The above identified SAE Paper No. 92029 describes a particular control valve design. As stated in the paper, the use of an air flow to a fuel injector assists in homogenation of fuel with air and also helps provide a desired fuel spray pattern. A beneficial results may be a reduction of hydrocarbons in the exhaust, a driveability improvement especially during transient conditions, and an engine performance improvement especially at an idle condition.

A three-stage flow control device is disclosed in the SAE Paper including a construction with a shaft movable axially in response to a selectively energized actuator device. The flow control device has two valve elements affixed to the shaft at spaced locations. Each valve element engages a valve seat when the shaft is in a first position. An air inlet means of the flow control device enters the housing at a place located between the two valve elements and valve seats. An outlet means is located opposite one of the valve elements and its seat and another outlet means is located opposite the other of the valve elements and its seat.

SUMMARY OF THE INVENTION

In an air assisted fuel injection system for an engine, a first range of air flow to the fuel injector is desirable during engine idle and during relatively low engine speeds and during relatively light engine loading conditions. At higher engine speeds and under heavier engine loading conditions, a substantially increased flow range is desirable. The above described ranges of air flows are achieved by the subject metering valve assembly.

Specifically, the valve assembly achieves the above described results by utilizing a pair of valving members each mounted on a common actuator shaft which is selectively moved in an axial direction. One of the valve members is fixed at an axially position on the shaft so that even slight axial movements of the shaft from a closed operative position towards a more opened operative position unseats the valve member and permits an air flow to the fuel injector through a first outlet. This produces the aforesaid first range of air flows. Even greater movements of the shaft away from the closed operative position unseats the other valve member for producing the aforesaid second range of air flows.

BRIEF DESCRIPTION OF THE DRAWINGS

Reference now is made to the accompanying drawings of an embodiment of the invention in which.

DETAILED DESCRIPTION OF THE PREFERRED EMBODIMENT

Figure 1:
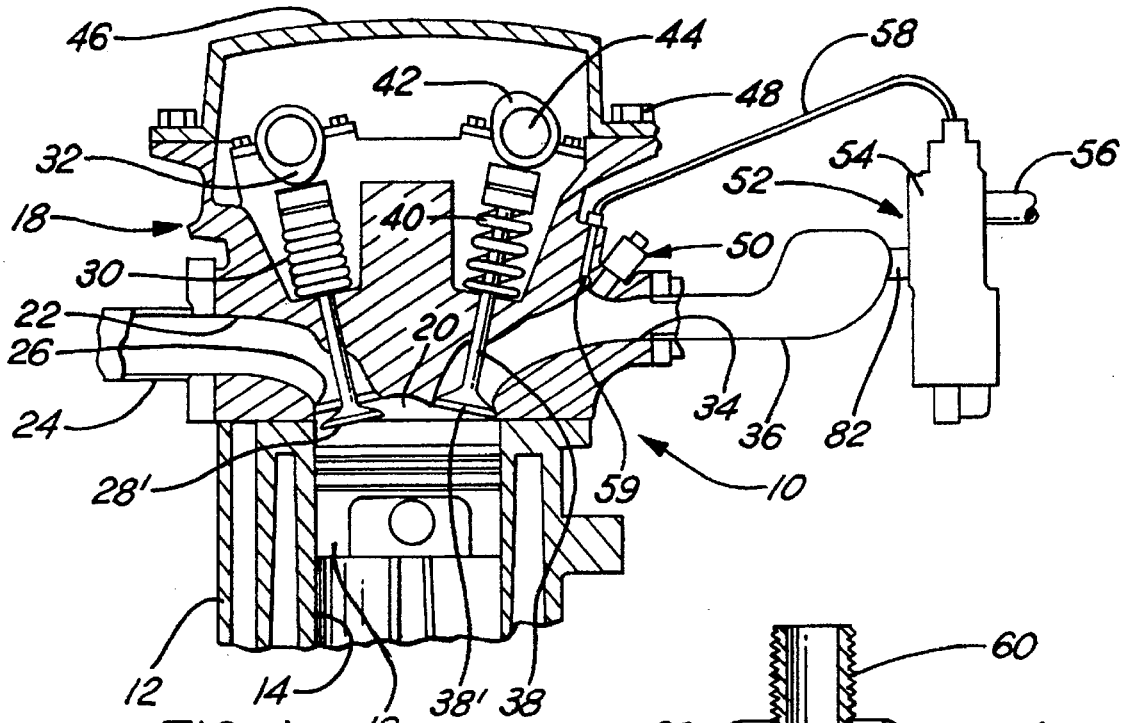
FIG. 1 is a partial view of a sectioned engine with an air assisted fuel injector and the subject air flow metering device.

Referring to FIG. 1, an internal combustion engine 10 is shown having an engine block portion 12 with cylinders 14 therein (only one shown). A piston 16 is supported in each cylinder 14 so that it can reciprocate in the direction of the cylinder's axis. A cylinder head assembly 18 is attached to the block portion 12 by fasteners (not shown). The cylinder head assembly 18 covers the upper end portions of the cylinders 14 to therefore define a variable volume combustion chamber 20.

The cylinder head assembly 18 is of the dual overhead camshaft type (DOHC). It defines an exhaust passage 22 therein extending from the combustion chamber 20 to an exhaust header 24. An exhaust valve seat 26 at the exit of the combustion chamber 20 which is normally seated against an enlarged head portion 28' of an exhaust valve 28 is shown in its opened position. As is known in the engine art, the valve 28 is activated against the force of a valve spring 30 by a lobe portion 32 of an exhaust camshaft.

Likewise, the cylinder head assembly 18 defines an intake passage 34 therein extending from the combustion chamber 20 to an intake manifold 36. An intake valve seat 36 is formed at the surface of the combustion chamber 20. Seat 36 is normally seated against an enlarged head portion 38' of an intake valve 38 which is shown in its normally closed position. As is known in the engine art, the intake valve 38 is activated against the force of a valve spring 40 by a lobe portion 42 of an intake camshaft 44. A camshaft cover member 46 overlies the upper portion of the cylinder head assembly 18 to enclose the camshafts. Cover 46 is attached to the cylinder head assembly 18 by fasteners 48.

Air is delivered to the combustion chamber 20 through intake passage 34. Fuel is delivered by a fuel injector 50 into the flow of air in the intake passage 34. The air flow in the intake passage is caused suction created by the increase in combustion chamber volume as the piston moves downward in the engine cylinder. A variety of fuel injector designs are available that are satisfactory. The typical type injector used today is an electrically activated type. As previously mentioned, it may be useful to introduce a flow of air about the fuel spray delivered by the fuel injector. This is done in a manner so that the air flow substantially encircles the spray of fuel, To regulate flow of air to the combustion chambers, a metering device or valve 52 is utilized. Specifically, the device 52 has a housing 54 with an air flow inlet connected to a conduit 56 running from a source of clean air such as from an air cleaner (not shown). Further, the housing 54 has an outlet connected by a conduit means 58 to a location in the cylinder head assembly adjacent the fuel injector 50. Still further, the housing 54 has another outlet connected by a conduit means 60 to the intake manifold 36 of the engine.

Figure 2:
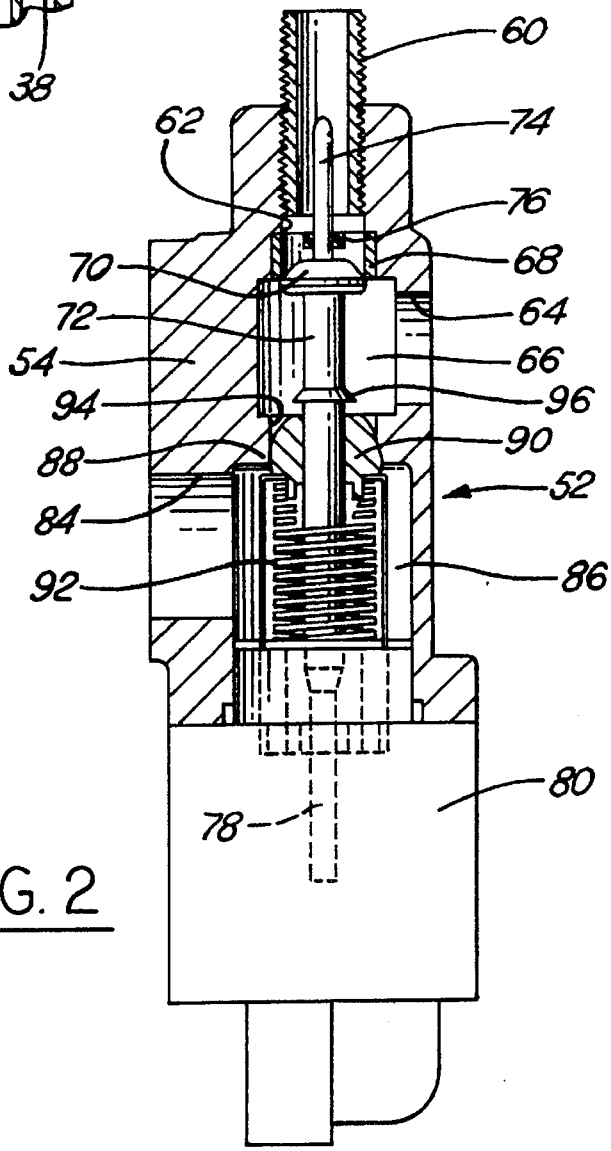
FIG. 2 is an elevational view of said metering device sectioned to show internal valving portions and the air inlet and outlets.

The specific structural aspects of the metering valve 52 are best learned by reference to FIG. 2. The uppermost portion of the valve housing 54 carries a tubular fitting 60 which is located downstream from an outlet passage 62 in the housing 54. As shown in FIG. 1, conduit means 58 is connected to the fitting 60. The downstream end of the conduit connects to cylinder head assembly 18. Specifically, the conduit is fluidly connected to a space formed about the outlet end portion of the fuel injector 50.

The housing 54 also has an inlet port and passage 64 which connects with the conduit means 56 as seen in FIG. 1. Conduit 56 in turn is operatively connected to a source of clean air such as from an air filter assembly (not shown). The inlet 64 extends into an interior space or chamber 66 having a valve seat forming member 68 an upper end. The seat member 68 is positioned between the chamber 66 and outlet passageway 62. A valving member 70 normally blocks flow into the outlet 62 by engagement with the valve seat member 68. Valve 70 is affixed to a movable shaft 72 which is capable of selective axial movement within the housing 54. Specifically, a reduced diameter upper end portion 74 of the shaft 72 extends through a bearing block means 76 and a lower end portion 78 of shaft 72 is attached to and guided by movements of a linear actuator assembly 80. A preferred form of the actuator 80 is an electric stepper type motor. When input signals are applied to the stepper motor, it responds by moving the shaft axially a pre-designed amount per signal. Movement of the shaft downward positions the valve 70 away from the seat forming member 68. Resultantly, air is drawn from the inlet passage 64 into chamber 66, then through fitting 60, and next through conduit 58, and reaches the space about the fuel injector 50. More specifically, air flows into the intake passage 34 at an outlet adjacent the outlet end portion of the fuel injector. This produces a flow of air adjacent to the spray of fuel from the injector. Preferably, the air is caused to enter the intake passage: through a generally circular outlet so that an encircling shroud is formed around the fuel spray pattern.

Figure 3:
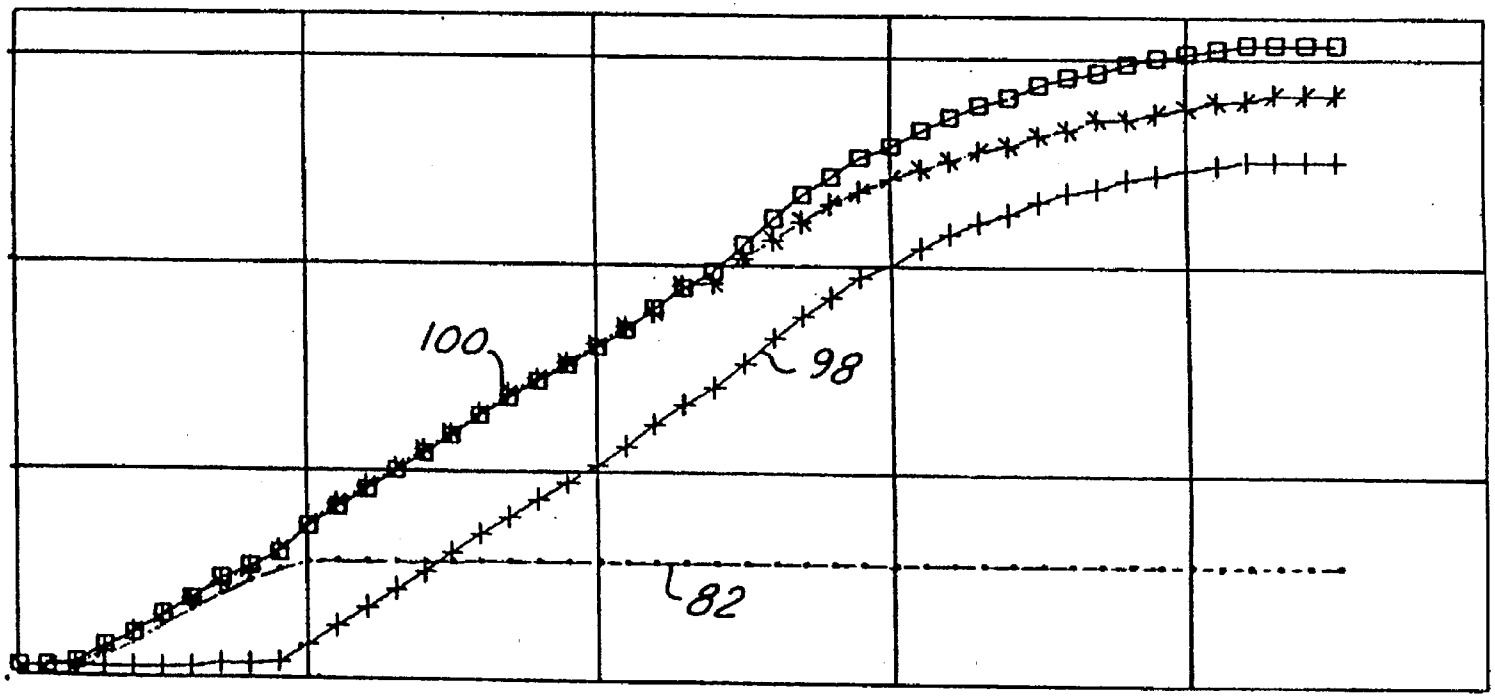
FIG. 3 is a graphical representation of the air flow characteristics of the preferred metering valve with opening of the valve actuator plotted on the horizontally extending axis and air flow quantity on the vertically extending axis.

The flow characteristics of air passing valve 70 to the fuel injector 50 is illustrated by plot 80 shown in FIG. 3. Note that when sonic conditions are met, the flow rate levels off to a constant value. When an additional flow rate is needed, it requires additional routing.

As previously indicated, additional air is often desirable under higher engine speeds and greater loading conditions. Referring back to FIG. 1, the metering device 52 has a second outlet which is connected by another conduit means 82 to the intake manifold 36. Alternately, the device 52 may be mounted directly to the manifold with the second outlet directly connected to the manifold interior. Specific details of the device are shown by FIG. 2. Housing 54 defines second outlet port and passage 84 which connects with conduit means 82 so as to pass an air flow to the intake manifold 36. The second outlet 84 extends inwardly to a chamber 86 formed in the housing. A valve seat portion 88 in the housing 54 is formed between chambers 66 and 86. A generally cone shaped valving member 90 is positioned in chamber 88 and against the seat portion 88 when in a closed operative position. A spring 92 urges the valve 90 into engagement with the seat 88 to block any flow past the valve 90.

When additional air to the intake manifold is desired, signals are set to the stepper motor 80 to cause it to position the shaft 72 further from the closed operative position shown in FIG. 2. until a protrusion or stop 96 on the shaft 72 engages the valve member 90. Further downward movement of shaft 72 unseats the valve 90 from seat 88. This permits air to be drawn through inlet 64 and into chamber 66, then through passage 94 and into chamber 86, and next through outlet 84 into the intake manifold 36 via conduit 82. Resultantly, the flow of air is shown by the plot labeled 98 in FIG. 3.

The total air flow to the combustion chamber from operation of the metering device 52 is the combined result of both flow 82 and flow 98. Thus, the total flow contributing to charging the combustion chamber by the metering device 52 is the plot labeled 100 in FIG. 3.

While a preferred embodiment of the invention has been shown and described, other embodiments will now become apparent to those skilled in the art. Accordingly, this invention is not to be limited to that which is shown and described but by the following claims.

I claim:

1. An improved air metering device for regulating a supply of air to an internal combustion engine having an air assisted fuel injection system including: a source of air; at least one air assisted type fuel injector mounted relative to an engine combustion chamber for selectively delivering fuel to an intake passage leading to an engine combustion chamber; air distribution means associated with the fuel injector to discharge a patterned flow of air adjacent the spray of fuel delivered by the fuel injector; the improved metering device comprising: a housing with an air inlet port to a first interior chamber therein whereby air is drawn into the metering device; said housing having a first outlet operatively connected so as to deliver air to the air distributing means associated with the fuel injector; said housing having a second outlet operatively connected so as to deliver air to the intake of the engine; said housing having a second interior chamber open to said second outlet; first valve seat forming means located between said first interior chamber and said first outlet; a first valve member operative with said first valve seat forming means to block air flow from the inlet to the first outlet when in a closed operative condition; a shaft mounted within said housing to permit selective axial shifting movement; said first valve member being attached to said shaft and movable therewith away from said first valve seat forming means to allow a flow of air from said inlet to said first outlet when in a non-closed operative condition; a second valve seat forming means located between said first and second interior chambers; a second valve member operative with said second valve seat forming means to block air flow from the inlet and first interior chamber to the second outlet when in a closed operative condition; spring means yieldably urging said second valve member into engagement with said second valve seat forming means; said second valve member being mounted upon said shaft in a manner permitting limited axial movement of said shaft without effecting the closed operative condition of said second valve member; means for causing opening movement of said second valve member by axial movement of said shaft after said limited axial movement thereof whereby air is delivered from said inlet and first interior chamber to said second interior chamber and said outlet.

2. The improved air metering device set forth in claim 1 in which said shaft has a radially outwardly protruding portion positioned between said first and second valve members and spaced sufficiently from said second valve member to permit said limited axial movement of said shaft without effecting the closed operative condition of said second valve member but thereafter causing the second valve member to unseat and move away from said second seat forming means.

3. The improved air metering device set forth in claim 1 and a selectively activated means associated with said shaft to permit axial positioning thereof whereby the first valve member can be opened in response to limited axial movement of said shaft followed by opening of said second valve member in response to further axial movement of said shaft.

4. The improved air metering device set forth in claim 3 in which said selectively activated means is an electric stepper type motor whereby said associated shaft is shifted a predetermined axial distance in response to each activating signal received by said motor.

* * * * *